US006152634A

United States Patent [19]

Kim

[11] Patent Number: 6,152,634

[45] Date of Patent: Nov. 28, 2000

[54] WRITING INSTRUMENT HAVING SANITARY MOISTENER

[76] Inventor: Kookan Kim, 609 Creek La., Flourtown, Pa. 19031

[21] Appl. No.: 09/328,613

[22] Filed: Jun. 9, 1999

Related U.S. Application Data

[63] Continuation-in-part of application No. 08/449,069, May 24, 1995, Pat. No. 5,938,359.

[51] Int. Cl.[7] ..... B43K 29/00

[52] U.S. Cl. ..... 401/195; 401/17; 401/23

[58] Field of Search ..... 401/195, 52, 17, 401/18, 23, 29, 34

[56] References Cited

U.S. PATENT DOCUMENTS

| | | |
|---|---|---|
| 255,652 | 3/1882 | Metcalf . |
| 311,361 | 1/1885 | Patterson . |
| D. 321,717 | 11/1991 | Hager . |
| 366,791 | 7/1887 | Ostrander . |
| 446,081 | 2/1891 | Schreiber . |
| 460,602 | 10/1891 | Stevens . |
| 897,128 | 8/1908 | Nichols et al. . |
| 915,417 | 3/1909 | Dewerpe . |
| 1,003,190 | 9/1911 | Mason . |
| 1,021,112 | 3/1912 | Reiche . |
| 1,033,520 | 7/1912 | Bator . |
| 1,307,359 | 6/1919 | Hugetz . |
| 1,749,565 | 3/1930 | Coryell . |
| 2,591,874 | 4/1952 | Ritchie . |
| 4,244,525 | 1/1981 | Manna . |
| 5,340,227 | 8/1994 | D'Andrade . |

FOREIGN PATENT DOCUMENTS

| | | |
|---|---|---|
| 1488448 | 6/1967 | France . |
| 2252941 | 8/1992 | United Kingdom . |

*Primary Examiner*—David J. Walczak
*Attorney, Agent, or Firm*—Howson & Howson

[57] ABSTRACT

A writing instrument having a sanitary moistener comprises an elongated body having a writing tip at one end and a supply of moistening liquid accessible at a location on the body of the instrument by a finger of an individual using the instrument, in order to moisten the finger to facilitate turning sheets of paper. The moistening liquid is supplied in a reservoir and delivered by a pump, or through a finger-operated valve. Alternatively, the moistening liquid is supplied in a liquid retaining porous medium having a part which can be exposed through an opening in the body of the instrument. In one embodiment, the liquid-retaining medium is accessible at the end of the instrument opposite to the writing tip. In two embodiments, the liquid-retaining moistener has conical passages receiving the ink cartridge and a side projection received in an open-ended slot in one of two parts constituting the body of the instrument.

19 Claims, 9 Drawing Sheets

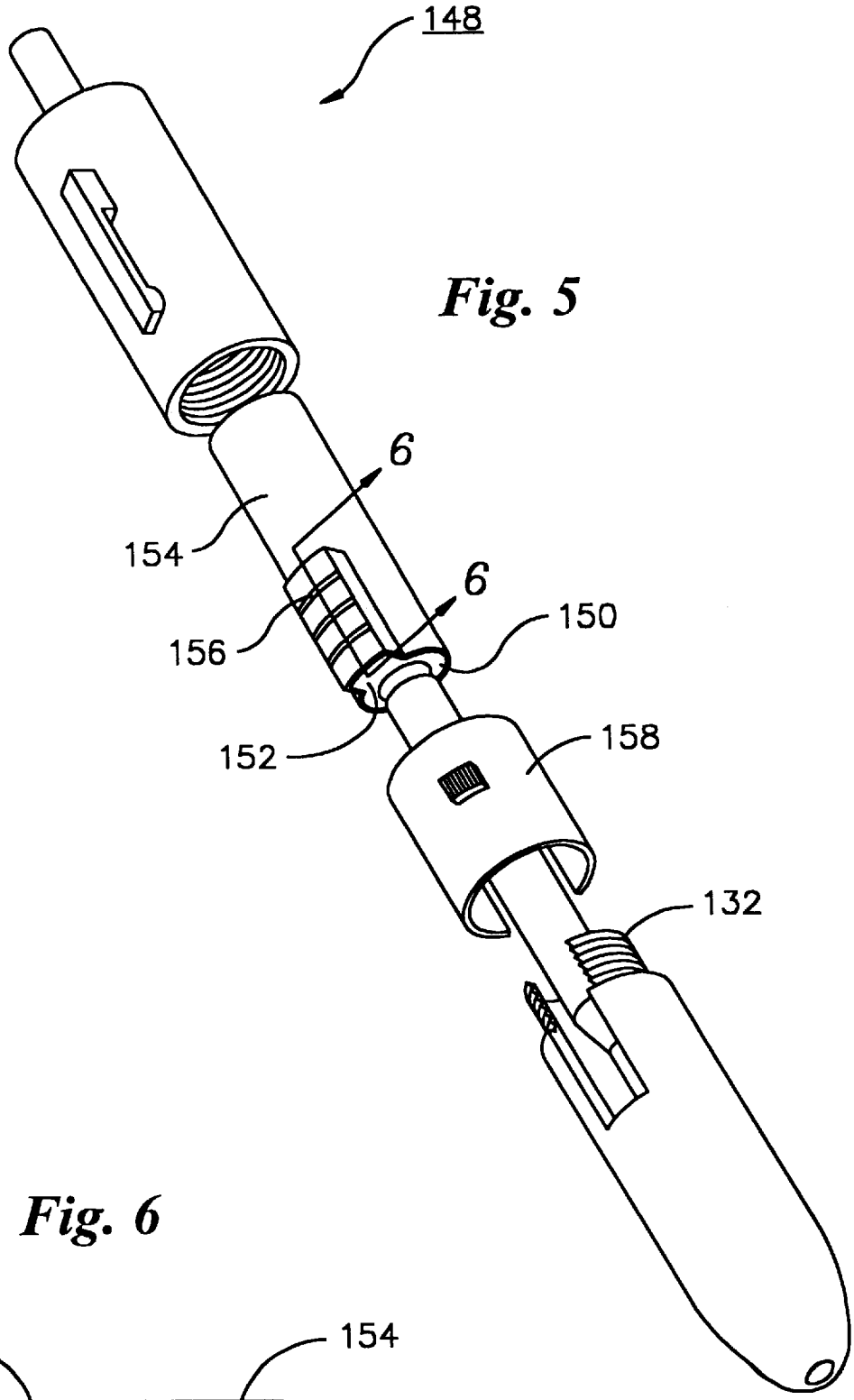
Fig. 5
Fig. 6
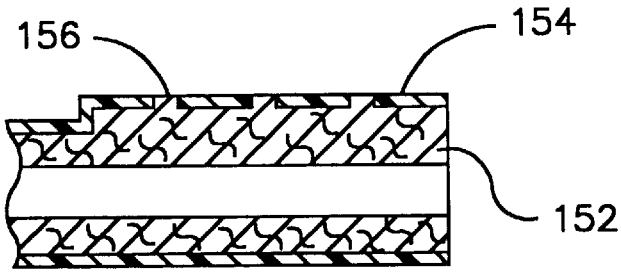

WRITING INSTRUMENT HAVING SANITARY MOISTENER

CROSS REFERENCE TO RELATED APPLICATION

This is a continution-in-part of my application Ser. No. 08/449,069, filed May 24, 1995, now U.S. Pat. No. 5,938, 359.

BRIEF SUMMARY OF THE INVENTION

This invention relates to moisture dispensers. It is specifically concerned with a writing instrument which has a sanitary moistener to facilitate turning sheets of paper, such as pages of a book.

Doing paperwork often involves executing two tasks, writing and turning pages of paper. School and business work frequently entail paging through large stacks of paper, concurrently or intermittently with making notes.

Because paper absorbs oil from skin, fingers tend to dry out after handling a quantity of paper. This is a problem since it is difficult to get a grip on pages of paper with dry fingers. Moisture must therefore be replenished after an individual has been doing paperwork for a while.

People typically provide this moisture by licking their fingers. Licking fingers is not a good solution to this problem since it is unsanitary. Potentially pathogenic microorganisms can be transmitted from one person's mouth to the paper, and from the paper to the mouth of another person.

The principal object of the invention is to provide a writing instrument having a moistener which enables the convenient, sanitary moistening of fingers to facilitate turning sheets of paper. Another object of the invention is to provide a writing instrument having a sanitary moistener which is simple and inexpensive to manufacture. It is also an object of the invention to provide a writing instrument having a sanitary moistener which is durable and utilizes a reliable mechanism for moistening fingers. Yet another object of the invention is to provide a writing instrument having a sanitary moistener which is easy to replenish with moisture, and environmentally friendly.

The writing instrument having a sanitary moistener in accordance with the invention comprises an elongated, hollow body having a first end. A marking medium is supplied to a writing tip at the first end of the body. A reservoir within the body contains a supply of moistening medium separate from the marking medium. The moistening medium is delivered from the reservoir to a location on the body remote from the first end, where it is accessible by a finger of an individual using the writing instrument in order to moisten the finger to facilitate turning sheets of paper.

Further objects, details, and advantages of the invention will be apparent from the following detailed description, when read in conjunction with the drawings.

BRIEF DESCRIPTION OF THE DRAWINGS

FIG. 5 is an exploded perspective view of still another embodiment of a writing instrument having a sanitary moistener;

FIG. 6 is a sectional view of taken on plane 6—6 of FIG. 5;

DETAILED DESCRIPTION

Figure 1:
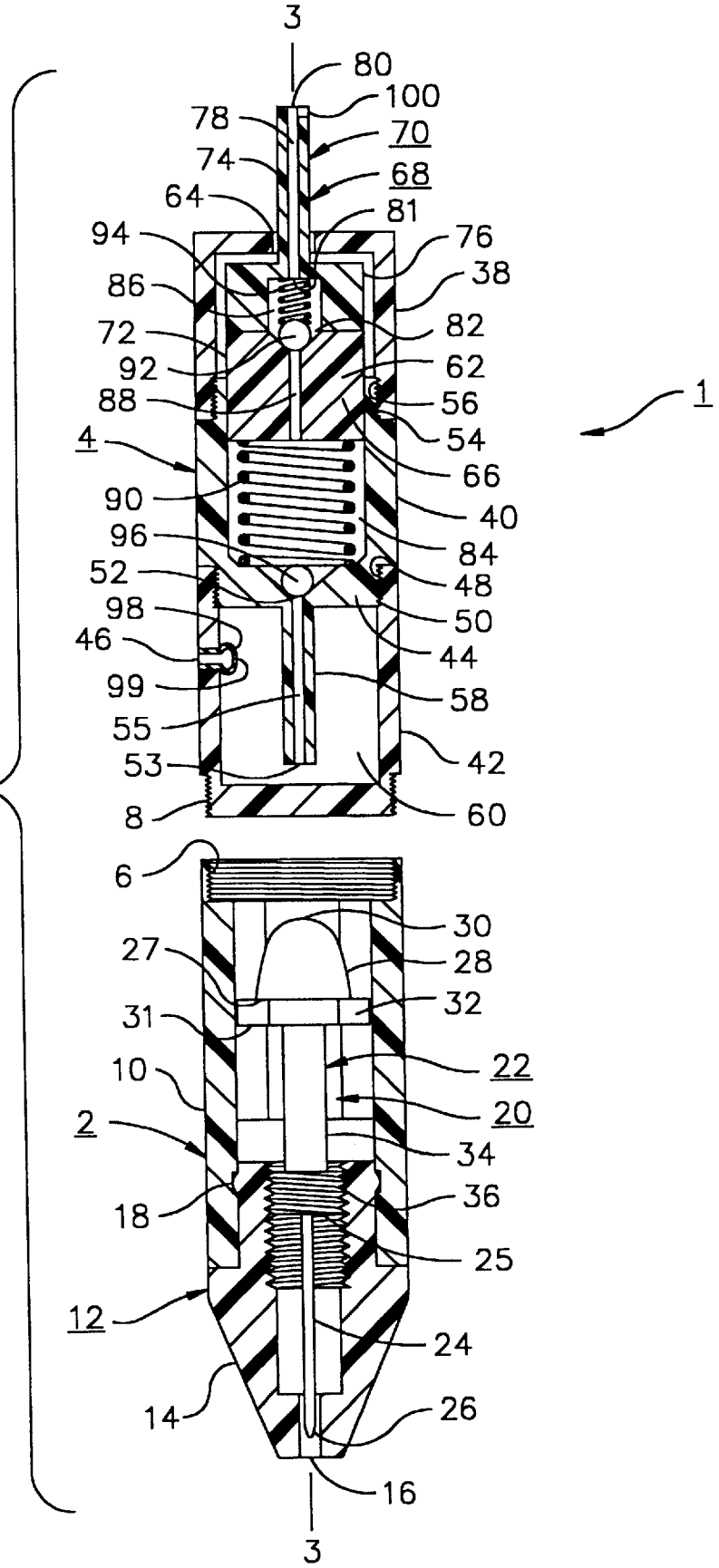
FIG. 1 is an exploded sectional view of a writing instrument having a sanitary moistener in accordance with the preferred embodiment.
Figure 2:
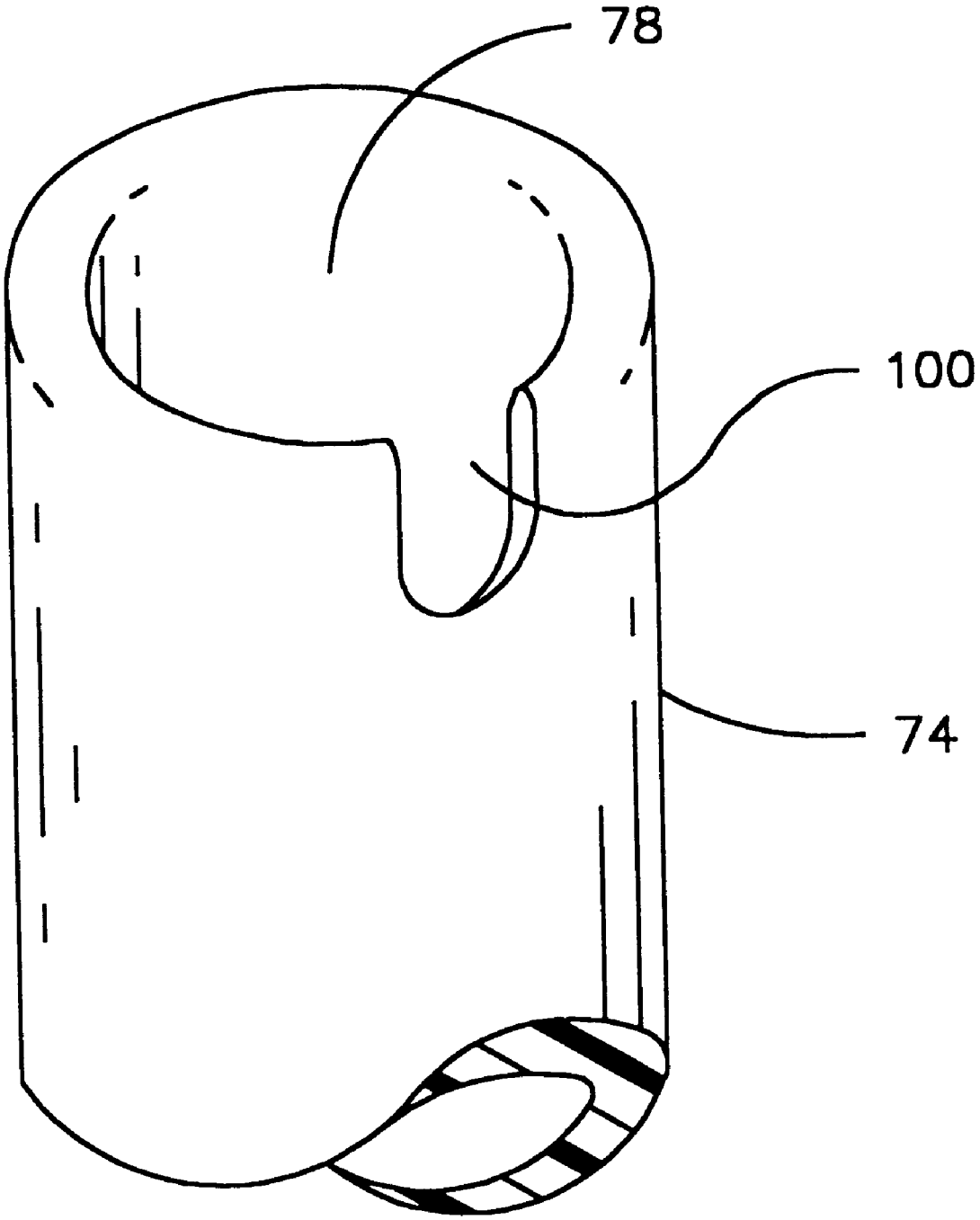
FIG. 2 is a fragmentary perspective view showing the top of the plunger of FIG. 1.

The preferred embodiment of a writing instrument having a sanitary moistener 1 is shown in FIGS. 1 and 2. The instrument 1 has the capability of writing and moistening fingers to facilitate turning sheets of paper, such as pages of a book.

The instrument shown in FIG. 1 has an elongated body which comprises a writing section 2 and a moistening section 4. The longitudinal axis of the instrument is indicated by line 3. Sections 2 and 4 can be secured together by engagement of threads 6 and 8.

The writing section 2 is short and its length is preferably no more than one half of the total length of the instrument 1. The preferred embodiment of the writing section 2 comprises a hollow top portion 10 having apertures at both ends, and a tapered, hollow bottom portion 12 also having apertures at both ends. The bottom portion 12 fits into the top portion 10 and has a ring 18 which snaps into a corresponding groove in the inner wall of the top portion 10. The ring 18 and groove cooperate to prevent portions 10 and 12 from moving axially relative to each other while allowing rotation of the bottom portion. The top portion 10 has a hexagonal inner wall. A section of the bottom portion 12 has a threaded inner wall.

A writing element 20, disposed inside of portions 10 and 12, comprises a molded synthetic resin shaft 22 and an ink cartridge 24 having a writing tip 26 at its lower end. The ink cartridge 24 fits into, and projects axially beyond, the lower end 25 of the shaft 22.

The shaft 22 has a knob 28 at its proximal end. The knob 28 has an aperture 30 at its proximal end to expose the proximal end of the ink cartridge 24 to the surrounding atmosphere.

A hexagonal element 32 below lower end 27 of the knob 28, cooperates with the hexagonal inner wall of the top portion 10 to prevent the writing element 20 from rotating while allowing the writing element to slide axially.

A threaded element 36, connected to the lower end 31 of the hexagonal 32 by a connecting portion 34 of the shaft, engages threads on the inner wall of the bottom portion 12, to move the writing element 20 axially when the bottom portion is rotated. The writing element 20 is movable between a position where it is disposed entirely within the top and bottom portions 10 and 12, and a position where the writing tip 26 of the ink cartridge 24 projects axially beyond the aperture 16 at the lower end of the bottom portion 12.

All of the components of the writing section 2 except for the ink cartridge 24 are preferably manufactured from synthetic resin. The ink cartridge 24 is typically made of metal.

The moistening section 4 comprises hollow upper, middle, and lower elements 38, 40, and 42. Lower and middle elements 42 and 40 are secured together by engagement of threads 48 and 50. Middle and upper elements 40 and 38 are secured together by engagement of threads 54 and 56. The parts of the moistening section may, of course, be secured together in other ways, for example, by a snap fit.

The lower element 42 is closed at its lower end and has a first aperture at its proximal end, and a second aperture 46 in its side. The lower end of the middle element 40 covers aperture 44 forming a reservoir 60 within the lower element 42.

The middle element 40 has an aperture at its upper end and a hollow elongated stem 58, which extends into the reservoir 60. The stem 58 has an internal passage with apertures 52 and 53 at its upper and lower ends respectively. Access to the reservoir for refilling is obtained by separating elements 40 and 42. Alternatively, a removable closure (not shown) can be provided in element 42.

The upper element 38 has top and bottom apertures 64 and 66.

A plunger 68, slidable axially within the upper and middle elements 38 and 40, comprises first and second elements 70 and 62 fixed together. The first element comprises a hollow, elongated stem 74 and a hollow base 76. The stem 74 extends through aperture 64, and projects axially beyond the proximal end of the upper element 38. The stem 74 has an internal passage 78, with aperture 80 at its upper end. The base 76 has an aperture 82 at its lower end. Thus, a passage 78 is provided in the first element 70, extending from aperture 80 to aperture 82.

The plunger fits the inner wall of middle element 40 and is slidable therein forming an expansible chamber 84 within the middle element 40.

A passage 88 extends through the second element 72 of the plunger 68.

A ball 92 seated in a conical recess at the upper end of passage 88, forms a first check valve. Spring 94, disposed above ball 92 between a space 86 in element 76, maintains the ball 92 seated against the conical recess.

A second ball 96 is disposed in a cone-shaped recess at the upper end of reservoir 60. The expansible chamber 84 is sealed off from passage 55 by ball 96. Gravity causes the ball 96 to seat when the instrument 1 is in use.

A coil spring 90, disposed within the expansible chamber 84 pushes upwardly on the plunger and ensures that the plunger automatically returns to its uppermost position when downward pressure on its stem 74 is released.

A rubber seal 98, having a slit 99, is disposed within aperture 46. Air passes through slit 99 into reservoir 60 when the pressure within reservoir 60 falls below atmospheric pressure. Slit 99 provides a one-way valve preventing water from leaking out of reservoir 60 while allowing air to enter the reservoir.

As shown in FIG. 2, the upper end of the stem 74 has a rounded edge with a mouth 100 to allow escape of air when the stem is depressed by the finger or thumb of a user.

It will be seen that the moistening section 4 is essentially a connection of a reservoir and a pump and that operation of the pump, by manual pressure and release of stem 74 causes liquid to flow from the reservoir to the upper end of the stem, where it moistens the finger or thumb of the user.

In the operation of the embodiment shown in FIGS. 1 and 2, the reservoir 60 is filled with water by separating element 40 from element 42. The stem 74 is pushed downward to move plunger 68 downward, compressing spring 90 and decreasing the volume of chamber 84.

When plunger 68 is released, spring 90 pushes the plunger 68 upwardly. Ball 96 is drawn off its seat as the plunger 68 travels upward. Liquid flows through passage 55 from the reservoir 60 to chamber 84 as the plunger 68 travels upward. Stem 74 is repeatedly pushed downward and released. Liquid begins to flow through the opening at the upper end of stem 74. Air enters reservoir 60 through slit 99 of rubber seal 98 as water is drawn out, thereby maintaining atmospheric pressure within reservoir 60.

Air flowing upward through passage 88 from chamber 84 pushes ball 92 off its seat, overcoming the force of check valve spring 94. When the air is entirely displaced from chamber 84, liquid simultaneously flows through passage 88, pushing ball 92 off its seat.

The liquid in the reservoir can be replenished at any time by separating the lower and middle elements 42 and 40 of the moistening section 4 from each other, thus exposing the reservoir 60.

The pump in FIG. 1 is exaggerated in size for the sake of clear illustration. In practice, the pump can be made both shorter and smaller in diameter, thereby making it possible to use a reservoir having a greater capacity.

Figure 3:
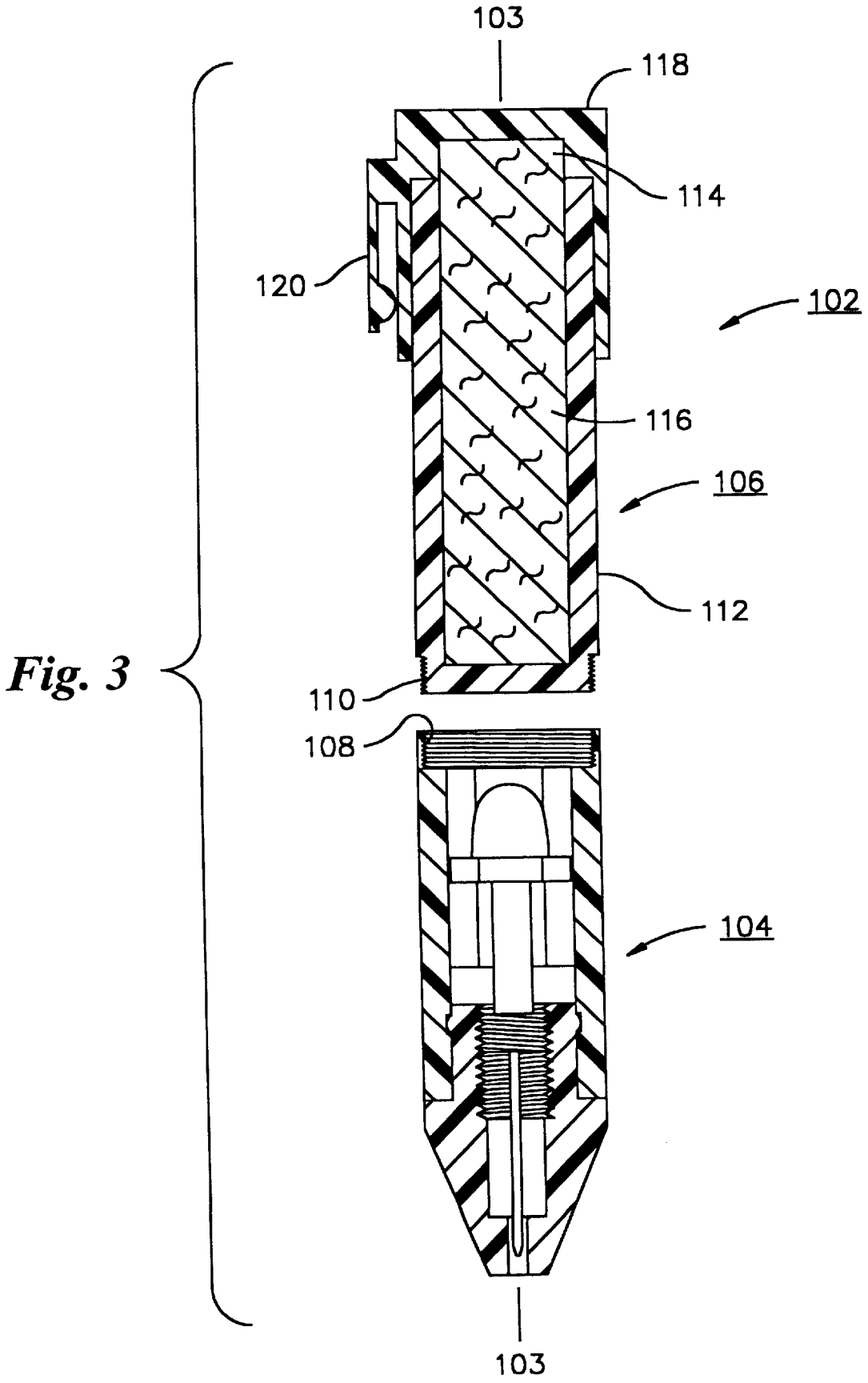
FIG. 3 is an exploded sectional view of another embodiment of a writing instrument having a sanitary moistener.

A second embodiment of a writing instrument having a sanitary moistener is shown in FIG. 3.

The elongated instrument 102 shown in FIG. 3 comprises a writing section 104 and a moistening section 106. The longitudinal axis of the instrument 102 is indicated by line 103. The writing section 104 is identical to the writing section 2 of the preferred embodiment shown in FIG. 1. Sections 104 and 106 are secured together by engagement of threads 108 and 110.

The moistening section 106 comprises a hollow body 112 having an aperture 114 at its upper end. A moistening element 116 is disposed within, and projects axially beyond, the upper end of the body 112. The moistening element 116 comprises a porous, hydrophilic, fibrous material saturated with water. The moistening element 116 is slightly compressed so that it fits snugly within the body 112 and does not fall out when the instrument is inclined or inverted. A removable cap 118 covers the proximal end of the element 116 and body 112. The cap 118 seals the interior of the body 112 off from the surrounding atmosphere to prevent the moistening element 116 from drying out. A clip 120 is provided on the exterior of the cap 118 so that the instrument can be carried on the outer pocket of a garment.

In the operation of the embodiment shown in FIG. 3, a user removes the cap 118 and touches the upper end of element 116. Fingers are moistened upon contact with element 116. The cap 118 can remain detached from the instrument 102 while it is being used for writing, and then returned when the instrument is no longer needed.

The moistener can be replenished by removing the moistening element 116 from the body 112, soaking it in water, and returning it to the body 112. The moistening element 116 can also be discarded and replaced by a new moistening element.

The embodiment shown in FIG. 3 is not as convenient to use as the preferred embodiment, since cap 118 must be removed to access moisture. However, it is simpler and less expensive to manufacture.

Figure 4:
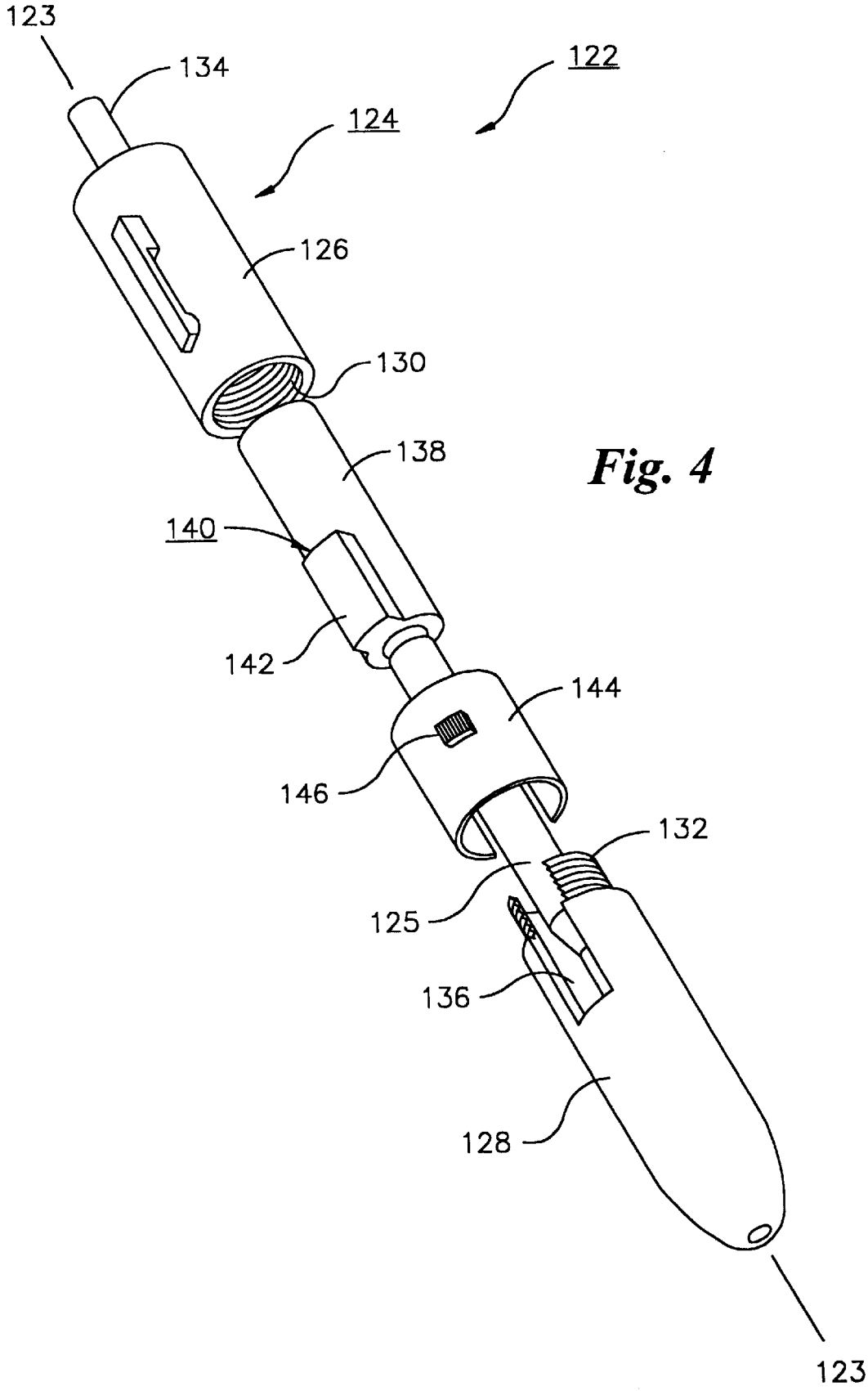
FIG. 4 is an exploded perspective view of yet another embodiment of a writing instrument having a sanitary moistener.

A third embodiment of a writing instrument having a sanitary moistener 122 is shown in FIG. 4.

The elongated instrument 122 shown in FIG. 4 comprises a body 124 having top and bottom sections 126 and 128. The bottom section 128 has an open-ended slot 136 adjacent to its upper end. Sections 126 and 128 are secured together by engagement of threads 130 and 132. The longitudinal axis of the instrument 122 is indicated by line 123.

A writing mechanism is conventional and comprises, a spring, an ink cartridge 125 having a writing tip, and a conventional catch mechanism of the kind used in retractable ball point pens. A plunger 134 at the upper end of the instrument is used to extend and retract the writing tip.

An elongated, hollow moistening tube 138 having a protrusion 140 is disposed within the top and bottom sections 126 and 128. The moistening tube 138 comprises a porous, hydrophilic, fibrous material saturated with water. The protrusion 140 of the moistening tube 138 is received in the open-ended slot 136 in the wall of the bottom section 128 and remains in the slot when parts 126 and 128 are assembled. The outer face 142 of the protrusion is substantially flush with the exterior of the bottom section 128.

The moistening tube 138 has an internal passage extending its entire length, with apertures at both ends. The ink cartridge is disposed within the moistening tube 138, and projects axially beyond, the ends of the tube.

A cover 144 having a projection 146, removably fits over the body of the instrument to cover the outer face 142 of the protrusion. The cover 144 seals the moisture tube 38 off from the surrounding atmosphere to prevent it from drying out. The cover 144 is slidable along the exterior of the top and bottom sections 126 and 128 by manipulation of projection 146.

In the operation of the instrument 122 shown in FIG. 4, a user slides the outer ring 144 along the exterior of the instrument 122, and touches the exposed outer face 142 of the protrusion 140, thereby moistening the finger which touches the face of the protrusion. The outer face 142 of the protrusion 140 can remain exposed while the instrument 122 is being used for writing. The cover 144 is returned to its closed position when the instrument is no longer needed.

The moistener can be replenished by disconnecting the top and bottom sections 126 and 128, removing the moistening tube 138, soaking it in water, and returning it. The moistening tube 138 can also be discarded and replaced by a new tube.

The open-ended slot 136 makes it easy to install and replace the moistener tube 138.

In an alternative version of the embodiment of FIG. 4, protrusion 142 can be eliminated, and a similarly shaped porous element can be installed permanently in the position of slot 136. In this version, one of the two porous elements serves as a reservoir while the other serves as a delivery element. A capillary may be provided in one or the other of the two porous elements to engage the other element and conduct liquid from the reservoir element to the protrusion.

A fourth embodiment of a writing instrument having a sanitary moistener 148 is shown in FIGS. 5 and 6.

A moistening tube 150, having a protrusion 152, is disposed within a reservoir within a protective capsule or cartridge 154. The portion of the capsule which covers the outer face of the protrusion 152 is ribbed, as shown in FIGS. 5 and 6. The spaces between the ribs provide access to the outer face 156 of the moistening tube 150. The instrument of the fourth embodiment 148 is identical in all other respects to the instrument 122 shown in FIG. 4.

The capsule 154 limits the area of the outer face 156 which is exposed to the surrounding atmosphere, thereby decreasing the rate at which the moistening tube 150 dries out when the cover 158 is removed. The capsule 154 also shields the rest of the instrument from exposure to the moistening tube 150.

Figure 7:
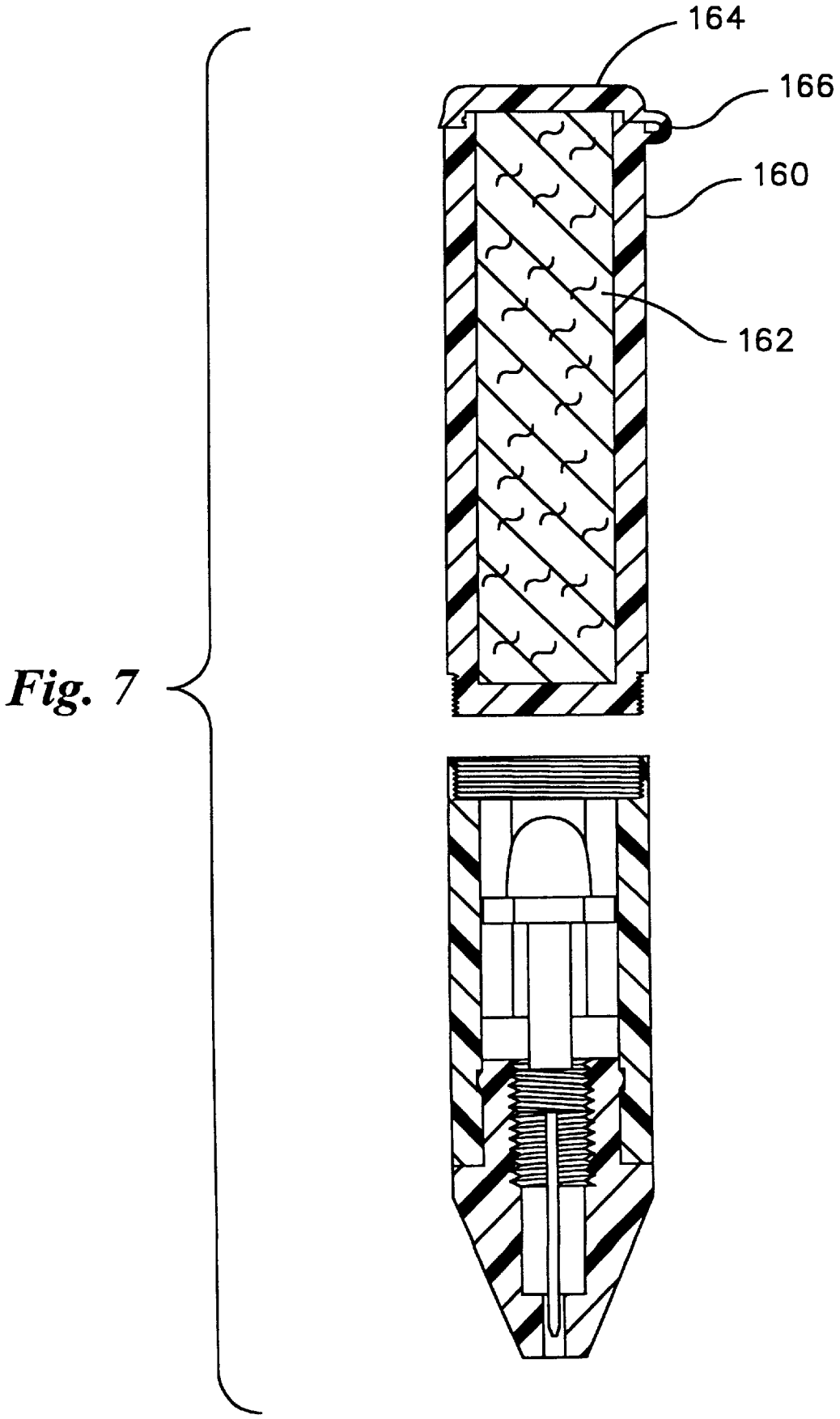
FIG. 7 is an exploded sectional view of a further embodiment of the invention.

FIG. 7 shows an instrument similar to that shown in FIG. 3, having a separable writing section and moistening section. The moistening section comprises a hollow body 160 having a moistening element 116 disposed within it. The moistening element is covered by a cap 164, which is connected to the body by a "live hinge" 166. The cap, body and hinge are molded as a unit. The cap is held closed by a snap fit, and can be snapped open by the user to expose the moistening element. The embodiment of FIG. 7 has the advantage, over the embodiment of FIG. 3, that the closure for the moistening element is permanently connected to the body of the moistening section and is less likely to be lost.

Figure 8:
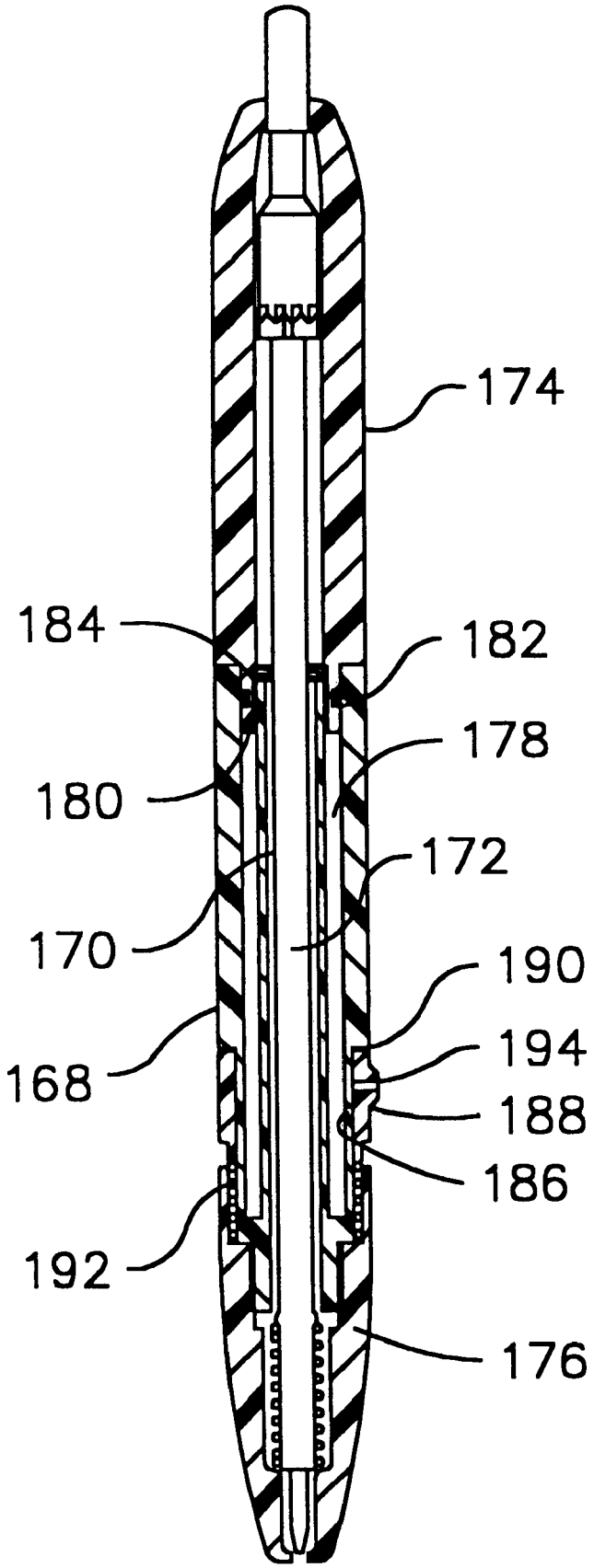
FIG. 8 is a longitudinal section of another embodiment of the invention.

The combination writing instrument and moistener of FIG. 8 has a moisture reservoir which is accessible by movement of a slide against a spring.

An intermediate body section 168 has a central passage 30 170, which accommodates a conventional ball point cartridge 172. An upper section 174 contains a conventional button-operated toggle mechanism for advancing and retracting the ball point cartridge. A lower section 176, which is threaded onto intermediate body section 168, houses a retraction spring, and conceals the tip of the ball point cartridge when the cartridge is in the retracted condition.

The intermediate section 168 is formed so that it has an annular reservoir 178 for containing a moistening liquid. This reservoir is permanently closed at the lower end, and is closable at the upper end by projection 180 of upper body section 174, which is threaded onto the inner part of body section 168 by threads 184. An annular sealing ring 182 fits into a groove in the outer surface of projection 180 and engages the inner surface of the outer part of body section 168 to prevent leakage of moistening liquid.

A radial opening 186 is provided in a reduced portion of intermediate body section 168 near its lower end. This opening is normally covered and closed by a longitudinally slidable, ring-shaped element 188, which surrounds the reduced portion of section 168. The opening and the ring-shaped element act as a manually operable valve. The ring-shaped element is urged against a shoulder 190 by a coil spring 192, concealed within a recess in lower body section 176, but is manually movable toward the lower end of the instrument to align its opening 194 with radial opening 186 to permit a small amount of moistening liquid to flow from the reservoir, through openings 186 and 194, to the user's finger.

The user can easily slide ring-shaped element 188 downward momentarily whenever moistening of a finger is desired, and a small drop of moisture will be applied to the tip of the same finger used to slide element 188. The reservoir 178 can be refilled easily by disconnecting element 174 from element 168.

Figure 9:
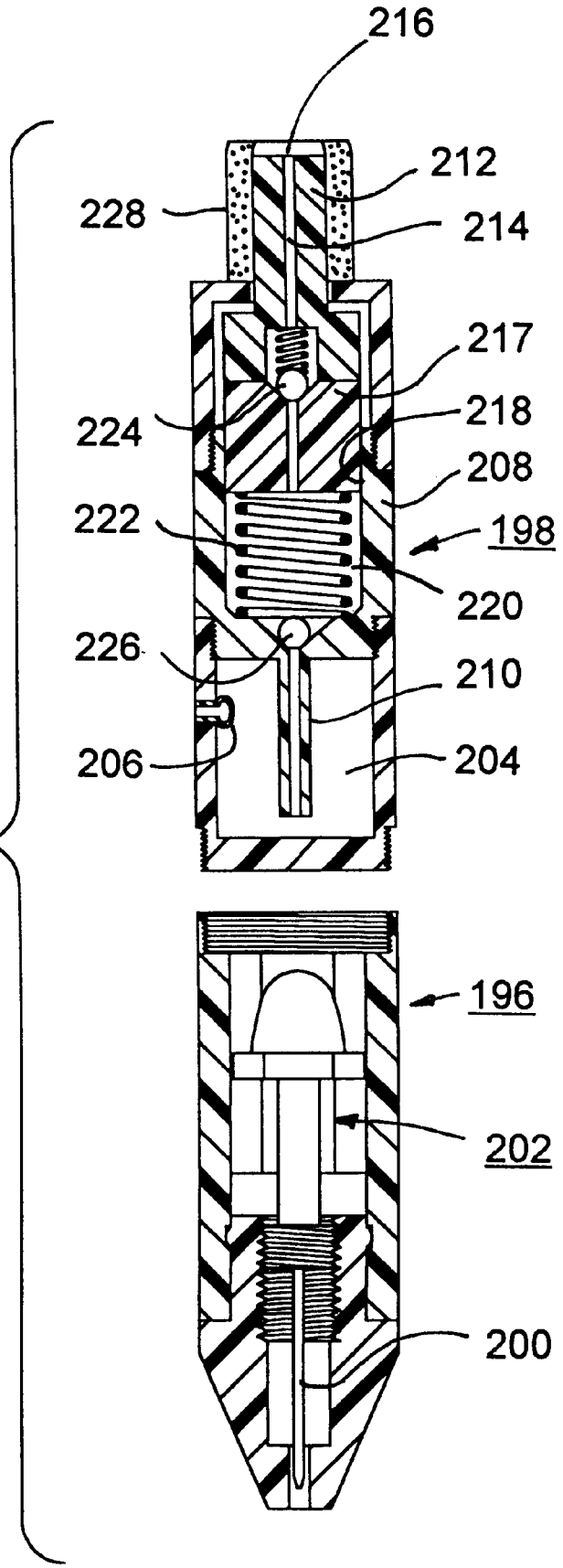
FIG. 9 is a longitudinal section of still another embodiment of the invention.

The writing instrument of FIG. 9 is similar to the instrument of FIG. 1, in that it comprises a writing section 196 and a moistening section 198. The writing section 196 contains an ink cartridge 200 and a mechanism 202 for extending and retracting the ink cartridge. The moistening section contains a reservoir 204, having a slitted rubber seal 206 serving as a pressure equalizing valve. Section 198 includes a hollow body 208, with a tubular stem 210 extending into the reservoir 204. A manually actuable plunger 212 extends axially through an opening at the upper end of section 198. The plunger has an axial passage 214 terminating in an opening 216 at the upper end of the plunger. The plunger is connected to a piston body 217, which cooperates with a cylindrical internal wall 218 of body 208 to provide a pump having a chamber 220, into which moistening liquid can be drawn from reservoir 204 through stem 210. Spring 222 urges the piston body upward to expand chamber 220, and balls 224 and 226 serve as one-way valves allowing the liquid to be drawn into chamber 220 as it expands, and causing liquid to be forced out through passage 214 as the plunger is depressed.

The plunger is surrounded by a sleeve 228. The sleeve is preferably made of a flexible, porous, liquid-absorbing material, typically an open-cell urethane foam polymer. It extends a short distance beyond the end of the plunger. Even though its lower end is engaged with the upper end of the housing of section 198, its flexibility allows the user to depress the plunger. The user's finger deforms the upper end of the sleeve, causing a portion of the upper end of the sleeve to be caught between the finger and the upper end of the plunger 212. As a result, the presence of the sleeve makes it difficult for the user's finger to close off opening 216 completely while depressing the plunger. Thus, the sleeve allows a quantity of moisturizing liquid to be ejected through passage 214 each time the plunger is depressed. The sleeve also prevents the ejected liquid from being sprayed to the side, and absorbs any excess liquid remaining on the end of the plunger after the plunger is operated.

The sleeve need not be in contact with the end of the housing of section 198, and if a clearance is provided, the sleeve can be rigid. Its porosity will allow air to escape through it when the plunger is depressed, and therefore moisturizing liquid will be allowed to flow outward through passage 214 even when the end of the sleeve is entirely closed off by the user's finger.

Figure 10:
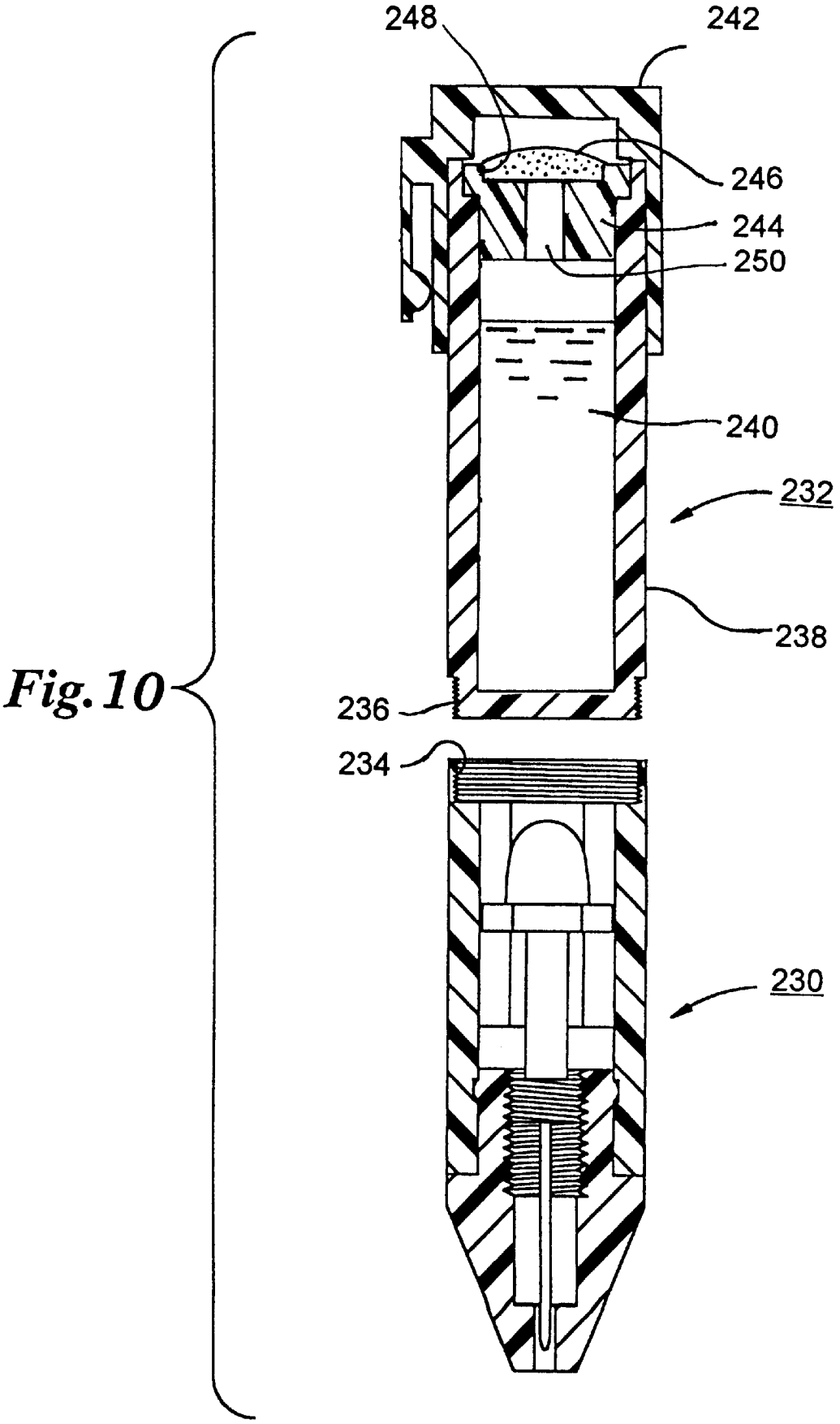
FIG. 10 is an exploded sectional view of still another embodiment of a writing instrument, utilizing a porous, controlled flow applicator to dispense a sanitary moistener.

The embodiment shown in FIG. 10 is similar to the embodiment of FIG. 3, in that it comprises a writing section 230 and a moistening section 232 connected together by engagement of threads 234 and 236.

The moistening section comprises a hollow, tubular body 238, having a hollow, internal space adapted to contain a moisturizing liquid 240. The moistening section is provided with a removable, protective cap 242, underneath which, the liquid-containing, hollow space of the tubular body 238 is closed off, at its end opposite to the end having threads 236, by a plug 244, which is held in place either by friction, as shown, or alternatively by threads or other suitable means.

The plug has a porous applicator 246 received in a recess 248, and a central opening 250 allowing the flow of moisturizing liquid 240 to the applicator. The porous applicator can be composed of any of a large number of materials including, for example, urethane, Nylon fleece, Neoprene, mohair and brushed tricot.

In use, the protective cap 242 is removed, and the instrument turned upside down at least momentarily to cause the liquid 240 to flow through opening 250 and into contact with porous applicator 246. The user can moisten a finger simply by touching the exposed surface of the applicator 246.

Each of the several embodiments of the instrument provides a writing instrument having a moistener to facilitate turning sheets of paper, and provides a convenient and sanitary alternative to licking one's fingers. The placement of the moisture access point at the top or on the side of the writing instrument makes it possible to use the instrument for writing and to moisten a finger or thumb with a minimum of difficulty. Each of the embodiments is structurally simple, and each inexpensive to manufacture. The instruments are easily replenished with moisture.

Various changes may be made to the described embodiments. For example, in the preferred embodiment shown in FIGS. 1 and 2, hinged flaps may be used in the pump instead of ball valves.

In the embodiments of FIGS. 1, 3, 7, 9 and 10, the writing section can be a retractable ball point device in which the extension and retraction of the writing point are effected by operation of a push-button or lever on the side of the writing section. It is also possible to modify the devices of FIGS. 1, 3, 7, 9 and 10 by incorporating in the writing section a toggle mechanism for advancing and retracting the ball point cartridge. The toggle mechanism can be operated by pressing axially on the moistening section.

In the embodiments such as in FIGS. 1, 8, 9 and 10, in which the moistening liquid is not contained by a porous medium, the reservoir can be made transparent so that the amount of moistening liquid remaining can be readily observed.

Also in the preferred embodiment, the air inlet of the reservoir may be provided at the upper end of the upper element and connected to the reservoir through a suitable passage within the walls of the upper, middle, and lower elements.

A liquid containing a bactericide may be preferable to water as the moistener. Also a perfume may be included in the moistening liquid.

As a further alternative, the liquid moistener can be supplied in a pressurized container and released by momentary manual opening of a valve. The pressurized gas can be butane, for example, supplied to a reservoir from a butane cartridge through an access valve at the top or on the side of the instrument. In a still further alternative, the moisturizing material can be provided in solid form as a gelatinous stick, and advanced for use by a screw mechanism similar to that used in a lipstick or lip balm stick. Finally, in a modified version of the embodiment of FIG. 10, the liquid can be dispensed by a roller ball of glass or plastics.

The principles of the invention can also be embodied in a pencil holder, which preferably utilizes a reservoir having a slidable valve similar to the valve shown in FIG. 8.

Still other modifications, which will occur to persons skilled in the art, may be made without departing from the scope of the invention as defined in the following claims.

What is claimed is:

1. A writing instrument having a sanitary moistener comprising:

an elongated, hollow body having a first end, an exterior, and an aperture;

a marking tip at said first end of the body;

means within said body for supplying a marking medium to said marking tip;

a reservoir within said body containing a porous material saturated with a moistening medium separate from said marking medium; and means for delivering said moistening medium from the reservoir to the exterior of said body;

wherein at least a part of the porous material is disposed in a cartridge within the body, and wherein the cartridge is elongated and has a wall which forms a projection extending transverse to the direction of elongation of the cartridge, said projection having means providing access to said porous material whereby a user can touch said porous material.

2. A writing instrument having a sanitary moistener according to claim 1, wherein said moistening medium contains a bactericide.

3. A writing instrument having a sanitary moistener according to claim 1, wherein said projection extends outwardly through the aperture in said body.

4. A writing instrument having a sanitary moistener according to claim 1, further comprising a removable cover which extends over said aperture, such that the porous material can only be delivered from the reservoir to the exterior of said body when said cover is removed from the aperture.

5. A writing instrument having a sanitary moistener according to claim 1, wherein said access-providing means comprises multiple gaps formed in said projection.

6. A writing instrument having a sanitary moistener according to claim 5, further comprising a removable cover which extends over said aperture, such that a user of the instrument can only touch the porous material when the cover is removed from the aperture.

7. A writing instrument having a sanitary moistener comprising:

an elongated, hollow body having a first end, an exterior, and an aperture;

a marking tip at said first end of the body;

means within said body for supplying a marking medium to said marking tip;

a reservoir within said body containing a porous material saturated with a moistening medium separate from said marking medium; and means for delivering said moistening medium from the reservoir to the exterior of said body;

the writing instrument further comprising an ink cartridge for delivering ink to said marking tip, and wherein the porous material has an internal passage extending along the direction of elongation of said body, said passage having an opening at least at one of its ends and receiving the ink cartridge, whereby the ink cartridge extends at least partially into said internal passage.

8. A writing instrument having a sanitary moistener according to claim 7, wherein said moistening medium contains a bactericide.

9. A writing instrument having a sanitary moistener according to claim 7, wherein a section of the porous material extends outwardly through the aperture in said body.

10. A writing instrument having a sanitary moistener according to claim 7, further comprising a removable cover which extends over said aperture, such that the porous material can only be delivered from the reservoir to the exterior of said body when said cover is removed from the aperture.

11. A writing instrument having a sanitary moistener according to claim 7, wherein at least a part of the porous material is disposed in a cartridge within the body.

12. A writing instrument having a sanitary moistener according to claim 7, wherein said passage has openings at both of its ends and the ink cartridge extends through said internal passage.

13. A writing instrument having a sanitary moistener comprising:

an elongated, hollow body having a first end, and an exterior;

a marking tip at said first end of the body;

means within said body for supplying a marking medium to said marking tip;

a reservoir within said body containing a porous material saturated with a moistening medium separate from said marking medium; and means for delivering said moistening medium from the reservoir to the exterior of said body;

wherein the porous material is elongated and has a projection, said projection extending transverse to the direction of elongation of the porous material and providing access to said porous material whereby a user can moisten a finger by touching said porous material at the location of said projection, and the body comprises first and second sections separably joined together in end-to-end relationship, the first section, when separated from the second section, having an opening at one end for receiving said porous material, said opening at one end being closed by the second section when said first and second sections are joined together, and said first section having slot means comprising an open-ended slot extending, in the direction of elongation of the body, from said opening at one end, the slot means receiving said projection when the porous material is inserted into said opening at one end of said first section, and the projection being located at least partially in said slot when the first and second sections are joined together, whereby the slot means forms an aperture providing access to the porous material by a user when the first and second sections of the body are joined together.

14. A writing instrument having a sanitary moistener according to claim 13, wherein said liquid contains a bactericide.

15. A writing instrument having a sanitary moistener according to claim 13, further comprising a removable cover which extends over said aperture, such that the porous material can only be delivered from the reservoir to the exterior of said body when said cover is removed from the aperture.

16. A writing instrument having a sanitary moistener according to claim 13, wherein at least a part of the porous material is disposed in a cartridge within the body.

17. A writing instrument having a sanitary moistener comprising:

an elongated, hollow body having a first end, an exterior, and an aperture;

a marking tip at said first end of the body;

means within said body for supplying a marking medium to said marking tip;

a reservoir within said body containing a porous material saturated with a moistening medium separate from said marking medium; and means for delivering said moistening medium from the reservoir to the exterior of said body;

wherein the porous material is elongated in the direction of elongation of the hollow body and substantially longer than the length of said aperture measured in said direction of elongation, and has a projection extending transverse to said direction of elongation, said projection extending into the aperture for access to said porous material by a user.

18. A writing instrument having a sanitary moistener according to claim 17, further comprising a removable cover which extends over said aperture, such that a user of the instrument can only touch the porous material when the cover is removed from the aperture.

19. A writing instrument having a sanitary moistener according to claim 17, wherein said moistening medium contains a bactericide.

* * * * *